US006769136B1

(12) United States Patent
Martelly

(10) Patent No.: US 6,769,136 B1
(45) Date of Patent: Aug. 3, 2004

(54) PAINT BUCKET/APRON COMBINATION

(76) Inventor: Philip R. Martelly, P.O. Box 497, Swansea, MA (US) 02777

( * ) Notice: Subject to any disclaimer, the term of this patent is extended or adjusted under 35 U.S.C. 154(b) by 0 days.

(21) Appl. No.: 10/631,294

(22) Filed: Aug. 1, 2003

(51) Int. Cl.[7] ..... A41D 13/04; B65D 25/00

(52) U.S. Cl. ..... 2/51; 224/148.4; 224/148.7; 220/570; 220/695

(58) Field of Search ..... 2/48, 51, 52, 49.2, 2/49.1, 49.3, 50; 220/570, 571, 571.1, 695, 702, 697, 698, 699, 700, 701, 731, 733, 734, 17.1, 17.3, 480, 481; 224/148.1, 600, 148.3, 602, 148.4, 606, 148.7, 629, 148.5, 576, 148.6, 663, 637, 230, 246, 665, 414; 206/1.7, 1.8, 1.9; D9/337, 516, 517, 522

(56) References Cited

U.S. PATENT DOCUMENTS

| | | | | | |
|---|---|---|---|---|---|
| 417,220 | A | * | 12/1889 | Bell | 224/148.6 |
| 453,490 | A | * | 6/1891 | Kropp | 2/49.2 |
| 2,591,482 | A | * | 4/1952 | Weltlich | 220/700 |
| 2,672,614 | A | * | 3/1954 | Zimmerman et al. | 2/49.3 |
| 2,717,109 | A | * | 9/1955 | Walsh | 224/148.4 |
| 2,945,614 | A | * | 7/1960 | Wittmann | 224/148.7 |
| 2,988,767 | A | * | 6/1961 | Tretwold et al. | 15/257.06 |
| 3,283,971 | A | * | 11/1966 | Jones | 224/183 |
| 3,329,307 | A | * | 7/1967 | Jacobson | 220/695 |
| 3,535,709 | A | * | 10/1970 | Johannes | 2/51 |
| 3,997,092 | A | * | 12/1976 | Pogwizd | 224/610 |
| D255,325 | S | * | 6/1980 | Hoyt | D9/515 |
| 4,972,982 | A | * | 11/1990 | Harbour | 224/270 |
| 5,566,391 | A | * | 10/1996 | Williamson | 2/51 |
| 5,893,489 | A | * | 4/1999 | Giarrante | 222/482 |
| 6,199,718 | B1 | * | 3/2001 | Ellis | 220/735 |
| 6,213,338 | B1 | * | 4/2001 | Cogdill | 220/700 |
| 6,260,730 | B1 | * | 7/2001 | Fellman | 220/495.02 |
| 6,616,110 | B1 | * | 9/2003 | McIntee | 248/213.2 |

* cited by examiner

*Primary Examiner*—A. Vanatta
(74) *Attorney, Agent, or Firm*—William Nitkin

(57) ABSTRACT

A paint bucket is disclosed held within a pocket formed in an apron disposed at the front of a user, such paint bucket having a semicircular front portion and a substantially flat bottom and rear portion with the top of the semicircular front portion curving downward to meet the top of the rear portion and having an inwardly disposed planar lip member extending rearward from the inside of the semicircular front portion, defining a paint receipt opening between the planar lip member and the rear portion.

3 Claims, 2 Drawing Sheets

PAINT BUCKET/APRON COMBINATION

BACKGROUND OF THE INVENTION

1. Field of the Invention

This invention resides in the field of painting devices and more particularly relates to a specially designed container for receipt of paint and an apron having a pocket for receipt of such container.

2. Description of the Prior Art

It has long been appreciated that it is difficult to climb a ladder to engage in painting with a brush in one hand while holding a paint bucket or can in the other hand. It has firer been appreciated in the prior art that it is easier for an individual to move up and down a ladder and have access to paint when a paint bucket/can carrying device is held onto the individual. A paint container carrier for use on an individual is disclosed in U.S. Pat. No. 3,997,092 to Pogwizd which provides a carrier device on a strap to hold a typical paint can with a strap extending around the user's neck and another around the user's waist. Other patents advance that concept, such as U.S. Pat. No. 4,972,982 to Harbour, which discloses a complex gimbal-like structure to hold a paint bucket so that the paint bucket remains level. The idea of providing an apron having a paint bucket holder is also found in the prior art, such as U.S. Pat. No. 5,566,391 to Williamson where an apron provides means for holding a container of paint and other painting related articles. The most pertinent prior art known to the Applicant is U.S. Pat. No. 2,945,614 to Wittmann, Sr. wherein an apron is provided having a neck strap, a waist strap and a paint container having a curved rear side which paint container is attached to the apron through a series of hooks at different levels. The paint container can also be integral with the body of the apron.

SUMMARY OF THE INVENTION

The invention herein provides a specially designed container for receipt of paint and an apron having a pocket thereon for receipt of such container for ease of use during painting. The pocket is provided on the front of the apron which pocket is approximately the shape of the paint container with its bottom approximately waist-high. The paint container of this invention has a semicircular front portion, a flat bottom and a generally flat rear portion. The front portion has a built-in lip extending inwards, forming an opening to allow access to the paint in the paint container. The sides of the front portion of the container near the user's body are curved downward to allow for ease of bending of the user while wearing the apron having a pocket containing the paint bucket of this invention. The apron has a neck strap and straps attached to the sides of the apron for tying around the back of the user.

DESCRIPTION OF THE PREFERRED EMBODIMENT(S)

Figure 1:
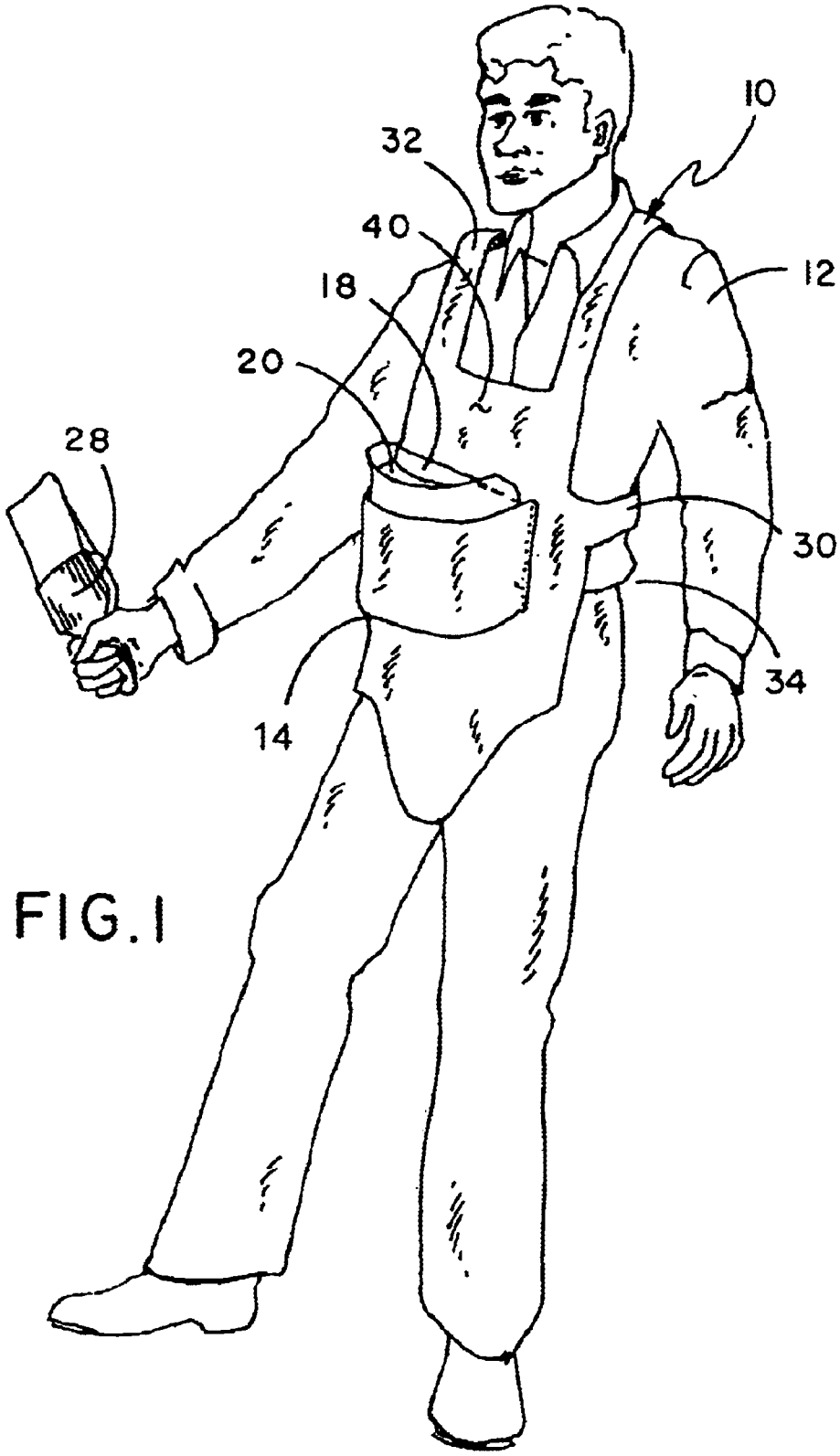
FIG. 1 illustrates a perspective view of a painter wearing the paint bucket/apron combination of this invention.
Figure 2:
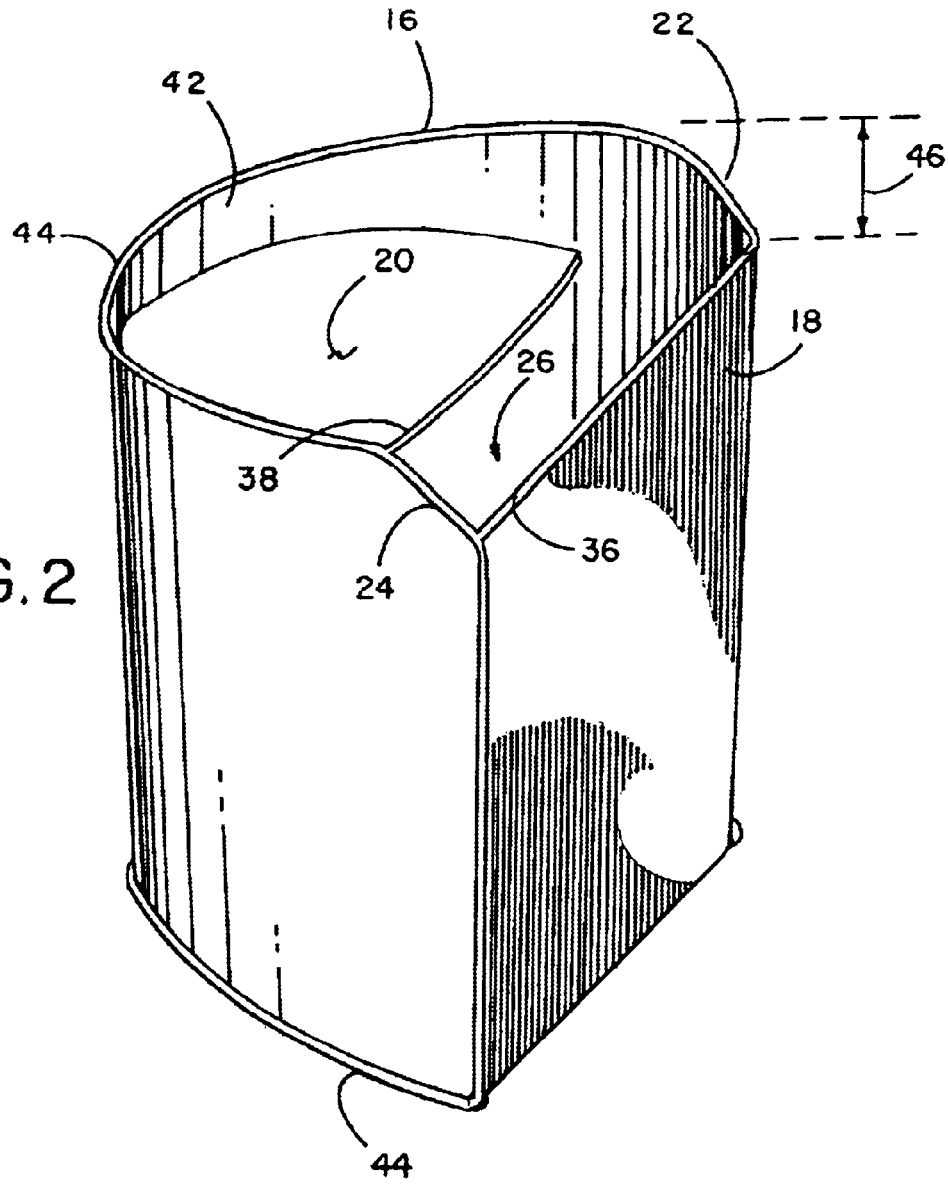
FIG. 2 illustrates a perspective view of the paint bucket of this invention removed from its pocket.

FIG. 1 illustrates a perspective view of painter 12 wearing apron 10 of this invention. Apron 10 has neck strap 32 which extends around the wearer's neck and supports the apron on the body of the wearer and two side straps 30, only one of which is illustrated, which keep the apron close to the body when tied together behind the wearer's back, especially when the wearer bends forward. On apron body 40 is disposed pocket 14, which pocket extends upward from approximately waist height 34 to just under the wearer's chest in which pocket is disposed paint bucket 16 of this invention. As seen in FIG. 2 paint bucket 16 has a semicircular front wall 42, a flat rear wall 18 and a generally flat bottom 44, forming a "D" in cross-section. Pocket 14 has a similar semicircular configuration and generally flat bottom 44, allowing paint bucket 16 to fit snugly in pocket 14. Rear wall 18 of the paint bucket is generally flat in configuration, as seen in FIG. 2, and fits within pocket 14 with the bucket extending somewhat above the top of the pocket. Within paint bucket 16 is planar lip member 20 which extends from semicircular front wall 42 inward a distance toward rear wall 18. Rear wall 18 has a top rear edge 36 that is separated from inner lip edge 38 of planar lip member 20. A paint receipt opening 26 is defined between inner lip edge 38 and rear wall 18 through which the paint is poured and which can be accessed when the user inserts brush 28, as seen in FIG. 1, through paint receipt opening 26 down into the paint. Any excess paint on brush 28 can be wiped off on the inner lip edge 38 of planar lip member 20 so that the excess paint falls back through paint receipt opening 26 into the inside of paint bucket 16. One then paints with the brush in the normal fashion and can wear the paint can/apron combination of this invention as one goes up and down a ladder. One of the improvements of paint bucket 16 is that its semicircular front wall 42 has first and second curved sides 22 and 24 each formed at a downward angle at each side to meet with the top rear edge 36 of rear wall 18. First and second curved sides 22 and 24 extend curvingly downward through distance 46 to allow the user to bend forward at the waist without having the can dig into the stomach area of the user. Planar lip member 20 prevents paint from spilling out of paint bucket 16 when the user bends forward. Thus the use of the paint bucket/apron combination of this invention is more practical and comfortable to use and wear than the bucket/aprons of the prior art.

Paint bucket 16 can be made of metal, plastic, coated paperboard or other suitable material by well known construction techniques. It can be either disposable or reusable, as desired by the user. The apron can typically be made of cloth or canvas-type material to provide sufficient strength and durability.

Although the present invention has been described with reference to particular embodiments, it will be apparent to those skilled in the art that variations and modifications can be substituted therefor without departing from the principles and spirit of the invention.

I claim:

1. A combination apron and paint bucket wherein such apron includes a body portion having a mid-waist portion, a neck strap for support around the neck, a waist strap for adherence of the body portion of the apron to the body of a wearer and a pocket formed at said mid-waist portion of the apron for receipt of a paint bucket therein, said paint bucket having: a semicircular front portion having a height, a top, a bottom and first and second side; a flat bottom; a substantially flat rear portion having a height, a top, a bottom, and first and second sides; and a planar lip member; said bottom of said semicircular front portion and said bottom of said rear portion attached to the bottom of said paint bucket; said first and second sides of said semicircular front portion attached, respectively, to said first and second sides of said rear portion, said top of said rear portion being lower than the top of said semicircular front portion, said top of said semicircular front portion curving downward to meet said top of said rear portion forming first and second curved sides, said planar lip member disposed within said paint bucket extending rearward from said semicircular front portion toward said rear portion and defining a paint receipt opening within said paint bucket between said planar lip member and said rear portion.

2. A paint bucket for use disposed in a pocket formed in an apron, comprising:

a semicircular front portion having a height, a top, a bottom, and first and second sides;

a rear portion having a top, a bottom and first and second sides, said first and second sides joined, respectively, with said first and second side ends of said semicircular front portion, said paint bucket forming a "D" shape in cross-section;

a paint bucket bottom;

said bottom of said rear portion and said bottom of said semicircular front portion connected to said paint bucket bottom, forming a fluid holding structure;

wherein said top of said rear portion is disposed lower than the top of said semicircular front portion; and said first and second sides of said semicircular front portion curve downward from the top of said semicircular front portion to the top of said rear portion.

3. The structure of claim 2 further including a planar lip member, said planar lip member attached to said semicircular front portion below said top of said semicircular front portion and extending toward said rear portion, defining a paint receipt opening between said planar lip member and said rear portion.

* * * * *